United States Patent [19]

Hillberg et al.

[11] Patent Number: 4,472,901

[45] Date of Patent: Sep. 25, 1984

[54] PISTOL GRIP ASSEMBLY

[76] Inventors: Robert L. Hillberg, 26 Mount Sanford Rd., Cheshire, Conn. 06410; Frederick F. Stevens, 177 Brett Rd., Fairfield, Conn. 06430

[21] Appl. No.: 325,220

[22] Filed: Nov. 27, 1981

[51] Int. Cl.[3] ..... F41C 23/00

[52] U.S. Cl. ..... 42/71 P

[58] Field of Search ..... 42/71 P, 7

[56] References Cited

U.S. PATENT DOCUMENTS 1,407,959 2/1922 Stokke ..... 42/7

3,352,046 11/1967 Warner et al. ..... 42/1 G

*Primary Examiner*—Charles T. Jordan

*Assistant Examiner*—Ted L. Parr

*Attorney, Agent, or Firm*—McCormick, Paulding & Huber

[57] ABSTRACT

A handgun has a frame which includes a hollow pistol grip with an opening through one of its sides to provide access to mechanism contained therein. A grip panel provides a closure for the opening and is releasably secured to the pistol grip by a single fastener which extends centrally through the panel and is threadably engaged with a retaining strip which extends across the opening. One end of the retaining strip is anchored by a pin mounted on the pistol grip. The other end of the retaining strip bears against the inner end of a marginal flange which surrounds the opening in the pistol grip. The pin may comprise a pivot pin which supports a part of the mechanism contained within the pistol grip.

15 Claims, 6 Drawing Figures

PISTOL GRIP ASSEMBLY

BACKGROUND OF THE INVENTION

This invention relates in general to firearms and deals more particularly with an improved grip assembly for a handgun or pistol of the type having a frame including a hollow pistol grip containing part of the gun mechanism and having an opening in at least one side for access to the mechanism. Such a gun includes a pair of grip panels secured to opposite sides of the pistol grip so that one of the panels provides a closure for the access opening.

It is generally desirable, for both mechanical and aesthetic reasons, to secure each grip panel to the pistol grip by a single fastener located centrally of the panel, however, because of limitations imposed by the mechanism it is sometimes not possible to attain this fastener arrangement. One alternative is to use a pair of spaced apart fasteners to secure opposite end portions of each grip panel. When a single fastener is utilized which engages a boss on the pistol grip, it may not be possible to position the boss in the most desirable location relative to the grip panel which it secures. The present invention is concerned with this problem.

SUMMARY OF THE INVENTION

A handgun has an improved grip assembly which includes a hollow pistol grip with an opening through at least one side thereof, a grip panel which overlies the one side and provides a closure for the opening, and fastening means which include a threaded fastener for releasably securing the grip panel to the pistol grip. In accordance with the invention the fastening means further includes a pin mounted on the pistol grip and a retaining strip which has an aperture through one end portion receiving the pin therethrough and which extends across the opening. The opposite end portion of the retaining strip is engaged with the pistol grip. The fastener is threadably engaged with the strip.

DETAILED DESCRIPTION OF PREFERRED EMBODIMENT

Figure 1:
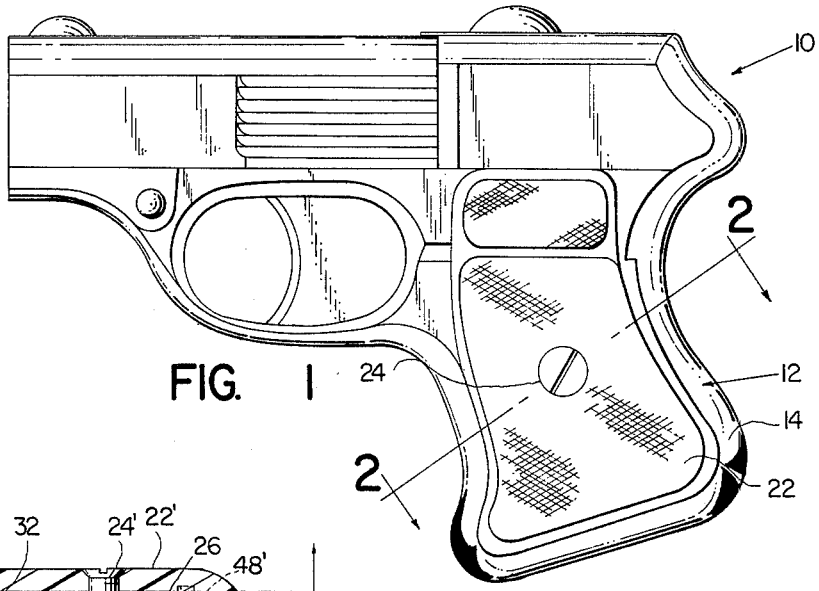
FIG. 1 is a side elevational view of a pistol having a grip assembly embodying the present invention.

Turning now to the drawing, a multi-barrel, breech loaded handgun or pistol, illustrated in FIG. 1 and indicated generally at 10, has a grip assembly embodying the present in vention and designated generally by the reference numeral 12. The grip assembly 12 essentially comprises a hollow pistol grip 14 which has an opening 16 through at least one of its sides. The assembly further includes a pin 18 mounted on the pistol grip 14 and at least partially disposed within it, and a panel retaining member or strip, indicated generally at 20, which extends across the opening 16 and is retained in assembly with the pistol grip by the pin 18 and by engagement with an associated portion of the pistol grip 14. The assembly also includes a grip panel 22, which overlies the opening 16 and provides a closure for it, and a fastener 24, which threadably engages the panel retaining strip 20 to releasably secure the panel 22 in assembled relation with the pistol grip 14. Another grip panel 22' of opposite hand is fastened to the opposite side of the pistol grip 14 and completes the assembly.

Considering now the gun 10 in further detail, the pistol grip 14 comprises an integral part of the gun frame and has a side wall 26 opposite its open side. An inwardly directed flange 28 extends along a marginal portion of the open side of the pistol grip and defines the opening 16. The grip assembly of the present invention may be used on handguns of various types having various kinds of firing mechanism. The illustrated gun 10 has a firing mechanism, indicated generally at 30, at least partially contained within the hollow pistol grip 14. The mechanism 30 includes a hammer 32 pivotally supported on the pin 18 and a mainspring assembly 33 for biasing the hammer toward a striking position relative to a firing pin, where the pistol is arranged for center fire, or the rim of an associated cartridge, where the pistol is adapted for rim fire. A hand or ratchet indexing pawl 34, which also comprises part of the firing mechanism, is pivotally supported generally adjacent the flange 28 on another pin 36 which extends transversely of the pistol grip near its rear wall. The illustrated hammer 32 and the pawl 34 are shown only in part and other parts of the mechanism 30 are omitted, for clarity of illustration. A detailed disclosure of a firing mechanism similar to the mechanism 30 is found in our copending application Ser. No. 308,427, filed on Oct. 2, 1981 for Handgun Firing Mechanism. The disclosure contained in the aforesaid application is hereby adopted by reference as part of the present disclosure.

Figure 2:
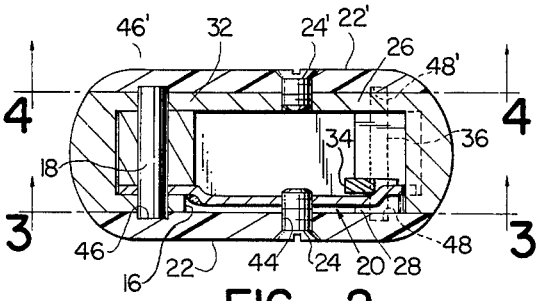
FIG. 2 is a somewhat enlarged sectional view taken along the line 2—2 of FIG. 1.
Figure 5:
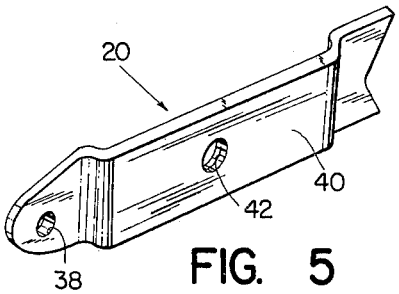
FIG. 5 is a somewhat enlarged perspective view of the panel retaining strip shown in FIGS. 2 and 3.
Figure 3:
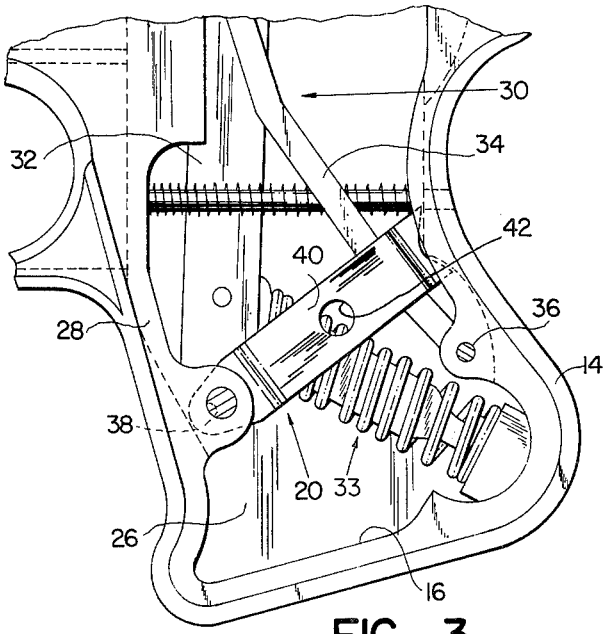
FIG. 3 is a fragmentary sectional view taken along the line 3—3 of FIG. 2.

The panel retaining strip 20 is preferably formed from resilient metal, has an aperture 38 near one of its ends, and includes an intermediate portion 40 which is outwardly offset from the plane of its ends to provide clearance for the movable pawl 34, as best shown in FIGS. 2 and 5. An internally threaded opening 42 for receiving the fastener 24 is formed in the intermediate portion 40, as best shown in FIG. 5. The retaining strip 20 is maintained in assembly with the grip panel 14 by the pin 18 which extends through the aperture 38. More specifically, the apertured end of the retaining strip 20 is disposed between the pivotally supported end of the hammer 32 and the inner surface of an associated portion of the flange 28, as best shown in FIG. 2. The panel retaining strip extends across the opening 16 and has its other end disposed within the hollow pistol grip 14 and generally adjacent the inner surface of an associated portion of the flange 28, as best shown in FIG. 2.

The two grip panels used in practicing the invention are preferably substantially identical, but of opposite hand, and may be made from various materials, such as wood or plastic. The presently preferred grip panels comprise plastic impregnated molded wood laminates. Each grip panel has a generally central aperture for receiving an associated fastener therethrough and at least one blind locating hole which opens through its inner surface, as hereinafter discussed.

Figure 4:
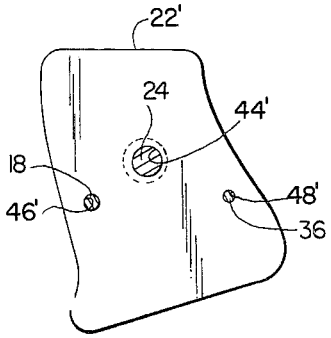
FIG. 4 is a somewhat reduced sectional view taken along the line 4—4 of FIG. 2.

In FIG. 4 the inner surface of the grip panel 22' is shown. This panel has a generally central aperture 44' which is countersunk at its outer end to receive the head of a fastener 24'. The grip panel 22' is provided with two locating holes indicated at 46' and 48'. The hole 46' receives an associated extending end portion of the pivot pin 18 whereas the hole 48' receives an associated projecting end portion of the pivot pin 36. The locating holes cooperate with the end portions of the pivot pins 18 and 36, which serve as locating members, to accurately locate the grip panel 22' relative to the pistol grip 14 and to prevent the grip panel from shifting laterally relative to the wall 26 or moving angularly about the fastener 24' which secures it to the wall 26.

The grip panel 22 is similarly constructed, however, the central aperture 44 preferably has a diameter somewhat larger than the diameter of the fastener 24 which secures it to the retaining strip 20. The tolerance between the hole 44 and the fastener 24 facilitates initial alignment of the fastener within the threaded opening 42. Since the panel retaining member or strip 20 is connected to the pistol grip 14 at only one of its ends it is free to move about the pin 18, as may be necessary, to facilitate proper alignment with the fastener 24 which secures the panel 22.

Figure 6:
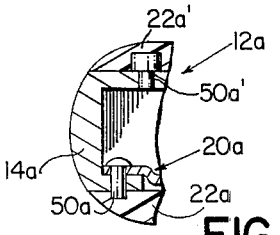
FIG. 6 is similar to FIG. 2 but shows another embodiment of the invention.

In the illustrated pistol 10, the pivot pins 18 and 36, which support mechanism within the pistol grip, also function as locating pins to accurately position the grip panels relative to the pistol grip and to permit movement relative thereto. However, when a grip assembly, in accordance with the present invention, is employed in another type of gun which does not have strategically located pivot pins to serve this dual function, suitable locating pins may be disposed in fixed position on the gun frame. Such a grip assembly is illustrated in FIG. 6 and indicated generally by the reference numeral 12*a*. The grip assembly 12*a* includes a pistol grip 14*a* which has fixed locating pins 50*a* and 50*a'* mounted at opposite sides thereof. The pins 50*a* and 50*a'* cooperate with associated locating holes in grip panels 22*a* and 22*a'* to retain each grip panel in its proper location on the pistol grip and to prevent lateral shifting movement and angular movement of each grip panel relative to its associated central retaining fastener (not shown). In the illustrated embodiment 12*a*, the pin 50*a* is headed and also serves to support and secure a retaining strip 20*a*, which releasably retains the grip panel 22*a* in assembly with the pistol grip 14*a* in the manner hereinbefore described. The pin 50*a'* is also headed, however, it should be noted that the head of the pin 50*a'* is located adjacent the outer side of the pistol grip 14*a* and is received within an associated locating hole in the grip panel 22*a'*. The pin 50*a'* is preferably press fitted into the pistol grip 14*a*, but if the pin should become loosened from the pistol grip, the enlarged head on the pin will prevent the pin from falling into the hollow pistol grip, where it could cause the firing mechanism to jamb or otherwise malfunction. The pin 50*a'* is captured by the pistol grip 14*a* and the grip panel 22*a'* and will continue to function to maintain the grip panel 22*a'* in proper alignment with the pistol grip 14*a* even in the event that it should become loosened within the pistol grip.

We claim:

1. In a handgun having a grip assembly including a hollow pistol grip having an opening through at least one side thereof, said handgun having operating mechanism at least partially contained within said hollow pistol grip, a pivot pin mounted on said pistol grip, said operating mechanism including a first part supported by said pivot pin for pivotal movement relative to said pistol grip, a grip panel overlying said one side and providing a closure for the opening, and fastening means including a threaded fastener for releasably securing the grip panel to the pistol grip, the improvement comprising said fastening means including an elongated retaining member having an aperture through one end portion thereof receiving said pivot pin therethrough, said retaining member being connected to said pistol grip at only said one end portion, said retaining member extending across said opening and having its opposite end engaged with said pistol grip, said retaining member having a threaded opening therein intermediate its ends, said threaded fastener extending through said grip panel and threadably engaged in said threaded opening, said retaining member being free to pivot about said pivot pin to facilitate proper alignment of said fastener and said threaded opening when said grip panel is being secured to said pistol grip by said fastening means.

2. In a handgun as set forth in claim 1 the further improvement wherein said fastening means includes an inwardly directed flange on said pistol grip at least partially defining said opening, said grip panel overlies said flange, and said opposite end has a recess receiving a portion of said pistol grip therein to limit pivotal movement of said retaining member about said pivot pin.

3. In a handgun as set forth in claim 2 the further improvement wherein said pivot pin extends through said flange and said one end portion is disposed adjacent the inner surface of said flange.

4. In a handgun as set forth in claim 2 the further improvement wherein said one end portion is disposed between the inner surface of said flange and a pivotally supported portion of said first part.

5. In a handgun as set forth in any one of claims 1 through 3 the further improvement wherein said threaded fastener extends through said grip panel generally centrally thereof.

6. In a handgun as set forth in any one of claims 1 through 3 the further improvement wherein said grip assembly includes locating means for preventing shifting movement of said grip panel relative to said pistol grip.

7. In a handgun as set forth in claim 6 the further improvement wherein said locating means comprises said pivot pin.

8. In a handgun as set forth in claim 6 the further improvement wherein said locating means further includes a blind hole in said grip panel receiving a portion of said pivot pin therein.

9. In a handgun as set forth in claim 6 the further improvement wherein said locating means comprises a second pin mounted on said pistol grip.

10. In a handgun as set forth in claim 9 the further improvement wherein said operating mechanism includes a second part and said second pin comprises another pivot pin providing pivotal support for said second part.

11. In a handgun as set forth in claim 10 the further improvement wherein said first and second pivot pins have end portions projecting outwardly beyond said flange and said locating means further includes holes in said grip panel respectively receiving said first and second pin end portions.

12. In a handgun as set forth in claim 9 the further improvement wherein said second pin has an enlarged head thereon disposed generally adjacent the outer surface of said pistol grip.

13. In a handgun as set forth in claim 12 the further improvement wherein said locating means further includes a blind hole in said grip panel receiving a portion of said enlarged head therein.

14. In a handgun having a grip assembly including a hollow pistol grip having an opening through at least one side thereof, a grip panel overlying said one side and providing a closure for the opening, operating mechanism at least partially contained within said pistol grip, and fastening means including a threaded fastener for releasably securing the grip panel to the pistol grip, the improvement comprising said fastening means including a first pin mounted on said pistol grip, and an elongated retaining member having an aperture through one end portion thereof receiving said first pin therethrough, said retaining member being connected to said pistol grip at only said one end portion, said first pin supporting said retaining member for limited pivotal movement relative to said pistol grip, said retaining member extending across said opening and having its opposite end portion engaged with said pistol grip, said retaining member having a threaded opening therein intermediate its ends, said threaded fastener extending through said grip panel and threadably engaged in said threaded opening, and locating means for preventing shifting movement of said grip panel relative to said pistol grip and including a second pin mounted on said pistol grip, said retaining member being free to pivot about said first pin to facilitate proper alignment of said fastener with said threaded opening when said grip panel is being secured to said pistol grip by said threaded fastener.

15. In a handgun having a grip assembly including a hollow pistol grip having an opening through at least one side thereof, operating mechanism including a movable part and at least partially contained within said hollow pistol grip, a grip panel overlying said one side and providing a closure for the opening, and fastening means including a threaded fastener for releasably securing the grip panel to the pistol grip, the improvement comprising an inwardly directed flange on said pistol grip at least partially defining said opening, said grip panel overlying said flange, said fastening means including a pin mounted on said pistol grip and pivotally supporting said movable part, and an elongated retaining member extending across said opening and having opposite end portions and an intermediate portion integrally connected to and extending between said opposite end portions, said opposite end portions engaging associated inner surface portions of said flange, one of said end portions having an aperture receiving said pin, said pin connecting said retaining member to said pistol grip for limited pivotal movement relative to said pistol grip, said intermediate portion being outwardly offset from the plane of said inner surface portions and disposed between portions of said flange at opposite sides of said opening for providing clearance for said movable part, said intermediate portion having a threaded opening therein, said threaded fastener extending through said grip panel and threadably engaging said retaining member within said threaded opening said retaining member being free to move relative to said pin to facilitate proper alignment of said threaded fastener with said threaded opening when said grip panel is being secured to said pistol grip by said fastening means.

* * * * *